United States Patent [19]

Torr

[11] 4,131,866

[45] Dec. 26, 1978

[54] SOLENOID DEVICES

[75] Inventor: Alan C. Torr, Alvaston, England

[73] Assignee: Expert Industrial Controls Limited, Leicestershire, England

[21] Appl. No.: 788,894

[22] Filed: Apr. 19, 1977

[30] Foreign Application Priority Data

May 1, 1976 [GB] United Kingdom ..... 17871/76

[51] Int. Cl.[2] ..... H01F 7/16

[52] U.S. Cl. ..... 335/262; 308/26; 335/255

[58] Field of Search ..... 335/262, 255, 251; 308/26

[56] References Cited

U.S. PATENT DOCUMENTS 3,318,642 5/1967 Peterson ..... 308/26

3,510,814 5/1970 Nordfors ..... 335/262

*Primary Examiner*—Harold Broome

*Attorney, Agent, or Firm*—Holman & Stern

[57] ABSTRACT

A solenoid device includes a cylindrical armature movable within a core tube the tube and armature being formed from magnetisable material. The armature is smaller in diameter than the interior diameter of the tube and a pair of axially spaced recesses are defined between the tube and the armature, each recess accommodating a circumferentially extending cylindrical member. The members serve to locate the armature within the tube and as relative axial movement occurs the members roll about their circumferential axes. The dimensions of the various parts are such that the members are nipped slightly when the device is assembled.

11 Claims, 4 Drawing Figures

PRIOR ART

SOLENOID DEVICES

This invention relates to solenoid devices of the kind comprising a tube of circular cross-section within which is mounted an axially movable cylindrical armature and an electrical winding, the armature when the winding is supplied with electric current being moved axially within the tube.

In the manufacture of such a device it is desirable to ensure that the armature can move as freely as possible within the tube and at the same time it is desirable to ensure that the concentricity of the armature and tube is maintained. Such desirable features are particularly important in a so called proportional device where it is required that for example, a fluid control valve is strictly controlled in accordance with the magnitude of the electric current flowing in the winding.

It is known to machine the internal peripheral surface of the tube and the peripheral surface of the armature so as to provide a good sliding fit and whilst this can take care of the problems of maintaining the concentricity it can lead to undesirable friction. Moreover, in the case where the tube is formed from magnetisable material, it means that two members formed from magnetisable material are in very close proximity. One solution to this problem is to provide spaced bearing rings on the armature. These can be formed from non-magnetisable material and can be made axially thinner so as to minimise the friction and to maintain so far as is possible, the concentricity. This construction however is not ideal and does tend to result in variation in the performance of the device.

An alternative approach would be to provide some form of linear bearing employing balls or rollers. Such a bearing however does require the provision of a cage to locate the balls or rollers and in addition, hardened tracks or surfaces on the armature and tube which are engaged by the balls or rollers. The armature at least is constructed from a material chosen for its magnetic properties and without destroying these properties or at least impairing the performance of the device, it is not possible to provide the required hard surface necessary to ensure that the device has an adequate working life.

It is therefore an object of the invention to provide a device of the kind specified in an improved form.

According to the invention a solenoid device of the kind specified comprises a circumferential recess defined in the presented surfaces of the tube or armature and an elongated resilient member in said recess, said member extending in a generally circumferential direction and having a substantially circular peripheral surface, the dimensions of the recess and member being such that when the device is assembled the member will be lightly pinched but capable of rolling within the recess during relative axial movement of the tube and armature.

According to a further feature of the invention said recess has an axial length equal to at least half the allowed relative movement of the tube and armature.

According to a further feature of the invention said member is formed as a coiled spring.

According to a still further feature of the invention said member is formed from non-magnetisable material.

Figure 1:
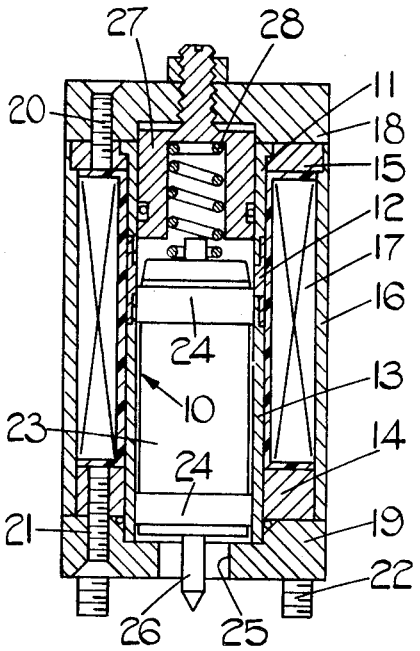
FIG. 1 shows one known form of solenoid device in cross-section.

Referring to FIG. 1 of the drawings the solenoid device includes a core tube 10 which is formed in three parts 11, 12 and 13. The parts 11 and 13 are formed from magnetisable material and each defines a right cylindrical inner surface. The part 12 is formed conveniently by a centrifugal casting method but is formed from non-magnetic material.

The solenoid includes a pair of end washers 14, 15 which are formed from magnetisable material and the washers 14 and 15 surround the parts 13 and 11 of the tube 10. The part 11 of the tube is provided with a step on its periphery which locates within a complementary recess in the washer 15. Surrounding the washers is a tubular yoke 16 and interposed between the yoke and the core tube is a winding 17 wound upon a former. End plates 18, 19 are provided, the end plate 18 being secured to the washer 15 by means of screws 20 and the end plate 19 being secured to the washer 14 by means of screws 21. The end plate 19 defines a step against which the end of the core tube 10 bears and the opposite end of the core tube bears against the end plate 18. Moreover, formed in the end plate 19 are apertures for the reception of screws 22 whereby the device can be secured to a valve housing or the like. Located within the core tube is an armature 23. This is of cylindrical form having a diameter slightly smaller than that of the core tube. The armature is provided with a pair of spaced bearing rings 24 which are formed from non-magnetic material and the rings guide the movement of the armature within the core tube and also maintain so far as is possible, the concentricity of the armature within the core tube.

An aperture 25 is provided in the end plate 19 through which extends a rod 26 connected to the armature 23 and conveniently the rod is shaped to form the movable part of a control valve.

Within the core tube and surrounded by the part 11 is a plug 27 which is adjustable from the exterior of the solenoid device and is provided with a blind recess in which is located a coiled compression spring 28. The compression spring acts between the base wall of the recess and the armature. When the winding is energised, the armature will move against the action of the spring towards the end face of the plug. It will be noted that the end portion of the armature adjacent the plug 27 is shaped. This is to ensure that the solenoid device has a particular force/stroke curve.

The rings 24 and the internal peripheral surface of the tube are of course carefully machined to provide a sliding fit with as little friction as possible whilst at the same time maintaining the concentricity of the armature and the tube.

Figure 2:
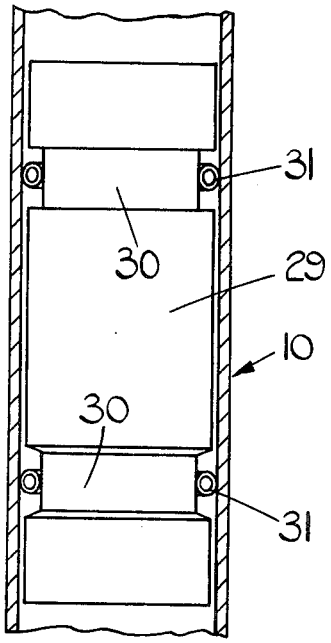
FIG. 2 shows how the device of FIG. 1 is modified in accordance with the invention and FIGS. 3 and 4 show alternative arrangements.

FIG. 2 shows how the device of FIG. 1 is modified in accordance with the present invention. The armature is indicated at 29 and is provided with a pair of spaced circumferential grooves 30. In this example the core tube 10 is shown as a continuous tube but it will be appreciated that it can be formed as shown in FIG. 1.

The grooves 30 are occupied respectively by a pair of elongated resilient members 31. The members 31 extend in the circumferential direction within the grooves and before they are assembled into the device they have a substantially circular peripheral surface. However, when assembled within the device they are lightly pinched so that their cross-section is generally eliptical.

The dimensions of the recesses 30 and the members 31 are such that upon relative axial movement of the armature and tube, the members roll about their longitudinal axes and in this manner the armature is supported relative to the tube in the concentric fashion whilst at the same time the resistance to relative movement of the armature and tube is very small.

In the arrangement of FIG. 2 the axial width of the grooves 30 is at least equal to half the allowed relative movement of the armature and tube since it will be appreciated that when the armature moves the members 31 will move through half the distance only.

Figure 3:
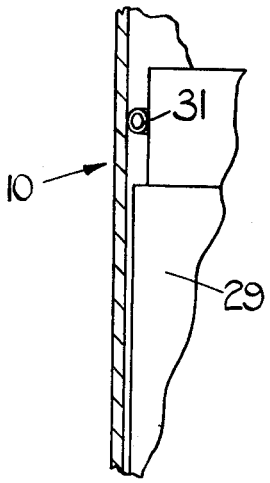
Figure 4:
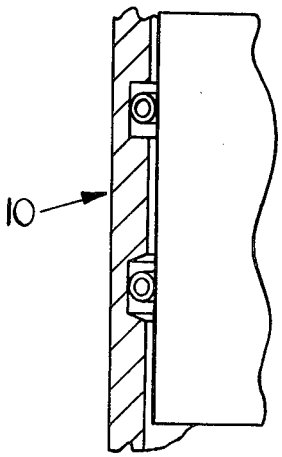

In FIG. 3 an alternative arrangement is shown in which the ends of the armature are of reduced diameter to define the equivalent of the grooves. In FIG. 4 the grooves are formed in the internal surface of the tube 10 and again the axial width of the grooves must be at least equal to half the allowed relative movement of the armature and tube. The arrangement of FIG. 4 does of course require that the wall thickness of the tube should be increased and this may be undesirable from the point of view of the performance of the device.

The members 31 are conveniently formed as a helically wound coiled spring and the length of the members is such that their opposite ends when the device has been assembled, lie in close proximity to each other. They may however be formed as a continuous hoop and their ends may overlap but in this case it is thought that some form of spacer may be required to minimise friction between the overlapping portions if the members. Moreover in this case the axial width of the recesses will have to be increased.

The members are formed from non-magnetisable material such for example as phosphor bronze or stainless steel. Whatever material is employed, it is desirable that it should not take a permanent set which would impair the operation of the device if it had been out of use for some considerable time.

The members 31 constitute a very stiff location for the armature which tends to resist any movement of the armature due to side loads imposed thereon. At the same time however there is low friction such as would impede relative axial movement of the armature and tube.

In FIGS. 2 and 4 it will be seen that the lower groove 30 has inclined ends faces this does not affect the performance of the device.

I claim:

1. A solenoid device:

comprising a tube of circular cross-section;

an axially movable cylindrical armature mounted within the tube;

an electrical winding, said armature, when the winding is supplied with electric current, moving axially within the tube;

means for defining a circumferential recess with respect to the internal surfaces of the tube or armature; and a rolling bearing means comprising an elongated resilient member in said recess, said member extending in a generally circumferential direction and having a substantially circular peripheral surface, the dimensions of said recess and said member being such that when the device is assembled the member will be lightly pinched between said tube and said armature but is capable of rolling within said recess during relative axial movement of said tube and said armature.

2. A device according to claim 1 in which said recess has an axial length equal to at least half the allowed relative movement of the tube and armature.

3. A device according to claim 1 in which said member is formed as a coiled spring.

4. A device according to claim 3 in which the ends of said spring lie in close end to end relationship to each other.

5. A device according to claim 3 in which the ends of said spring overlap in the circumferential direction.

6. A device according to claim 5 including a spacer between the overlapped end portions of the spring.

7. A device according to claim 1 in which the member is formed from non-magnetic material.

8. A device according to claim 1 in which the recess is defined by a groove formed in the armature.

9. A device according to claim 1 in which the recess is defined by a groove formed in the tube.

10. A device according to claim 1 in which the recess is defined by an end portion of the armature which is of reduced diameter.

11. A device according to claim 1 in which a pair of recesses are provided, said recesses being axially spaces, each recess accommodating a resilient member.

* * * * *